US005423137A

United States Patent [19]

Cochran

[11] Patent Number: 5,423,137

[45] Date of Patent: Jun. 13, 1995

[54] PAVEMENT CUTTING AND EXCAVATING TOOL

[76] Inventor: Gary L. Cochran, 1505 N. Shefford, Wichita, Kans. 67212

[21] Appl. No.: 151,536

[22] Filed: Nov. 12, 1993

[51] Int. Cl.[6] ..... E02F 3/76

[52] U.S. Cl. ..... 37/408; 37/403; 37/94; 404/90

[58] Field of Search ..... 37/403, 407–410, 37/903, 91, 92, 94; 414/722, 724, 912; 404/90; 299/39; 172/120

[56] References Cited

U.S. PATENT DOCUMENTS

| | | | |
|---|---|---|---|
| 3,109,248 | 11/1968 | Vos . | |
| 3,471,950 | 10/1969 | Ferwerda . | |
| 3,595,411 | 7/1971 | Ables | 37/403 |
| 3,891,342 | 6/1975 | Roe | 37/410 |
| 4,023,288 | 5/1977 | Roe . | |
| 4,100,688 | 7/1978 | Grist . | |
| 4,420,189 | 12/1983 | von Ruden . | |
| 4,490,070 | 12/1984 | Upchurch et al. | 37/403 |
| 4,512,090 | 4/1985 | Billings . | |
| 4,602,821 | 7/1986 | Schaeff . | |
| 4,793,732 | 12/1988 | Jordon . | |
| 4,803,789 | 2/1989 | Hackmack . | |
| 4,910,891 | 3/1990 | Martin et al. . | |

FOREIGN PATENT DOCUMENTS

| | | | |
|---|---|---|---|
| 2027096 | 2/1980 | United Kingdom . | |
| 91/10016 | 7/1991 | WIPO | 37/403 |

*Primary Examiner*—Randolph A. Reese
*Assistant Examiner*—Spencer Warnick
*Attorney, Agent, or Firm*—Woodard, Emhardt, Naughton, Moriarty & McNett

[57] ABSTRACT

A pavement cutting and excavating tool comprising an excavation bucket and a cutting disc. The tool is mountable to a construction vehicle such as a backhoe. A disc housing is disposed in the backhoe bucket, and the cutting disc is disposed in the housing. Accordingly, the cutting disc of the present invention is substantially more narrow than the backhoe bucket in which it is partially disposed.

12 Claims, 5 Drawing Sheets

PAVEMENT CUTTING AND EXCAVATING TOOL

FIELD OF THE INVENTION

The present invention relates generally to tools for cutting asphalt or concrete pavement, and more particularly to a cutting disc mountable to a conventional backhoe.

BACKGROUND TO THE INVENTION

It is frequently necessary to cut concrete or asphalt pavement, and high-powered pavement cutting tools have been developed specifically for that job. For example, a full width milling machine has been developed to cut a path wider than a conventional backhoe bucket so that a backhoe may be used to access water lines, sewer lines, gas lines, etc., buried beneath a street. Similarly, large, powered circular saws have been developed for making narrow cuts around deteriorated sections of pavement so that a backhoe can be used to excavate the old pavement. These narrow cutting saws are also effective for making "across street" cuts when full width milling machines are not used.

It can be seen that many of the jobs which require a concrete cutting tool also require a backhoe to remove dirt and old concrete. As indicated above, many utility lines are buried under roads or streets and can only be repaired by cutting the street with a cutting tool and using a backhoe to excavate the asphalt and dirt. These jobs are frequently relatively small in scale and must be performed as quickly and inexpensively as possible by local utility or construction companies.

It would be efficient to have one tool which could perform both as a pavement-cutting saw and a backhoe, so that relatively small, roadway construction jobs could be performed with minimum number of tools and personnel. The prior art, however, has not provided such a device.

A need therefore exists for a construction tool which functions both as a backhoe bucket and as a narrow cutting saw for concrete and asphalt pavement. The present invention addresses this need.

SUMMARY OF THE INVENTION

Briefly describing the present invention there is provided a pavement cutting and excavating tool comprising an excavation bucket and a cutting disc. The tool is mountable to a construction vehicle such as a backhoe. A disc housing is disposed in the backhoe bucket, and the cutting disc is disposed in the housing. The cutting disc of the present invention is substantially more narrow than the backhoe bucket.

One object of the present invention is to provide a combination backhoe bucket/cutting disc capable of making narrow cuts in concrete and asphalt.

Further objects and advantages of the present invention will be apparent from the following description.

DESCRIPTION OF THE PREFERRED EMBODIMENT

Figure 2:
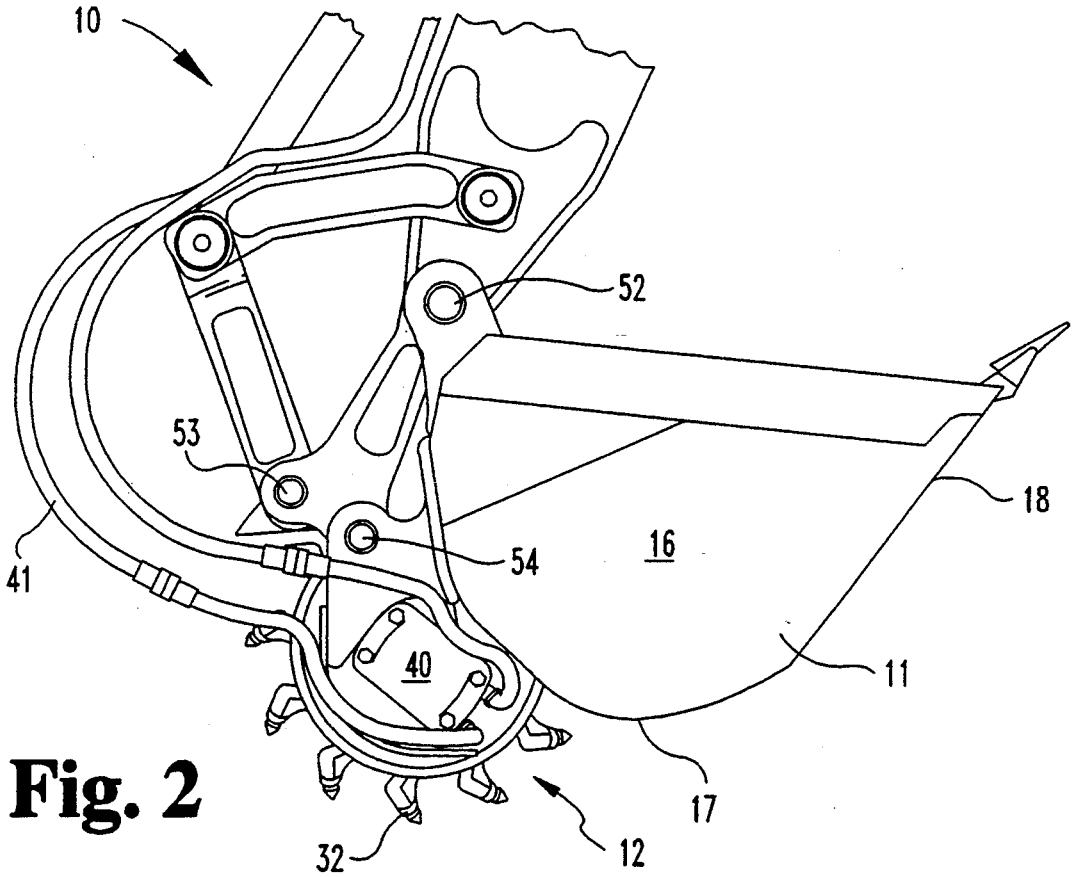
FIG. 2 is a left side elevational view of the pavement cutting and excavating tool of FIG. 1.
Figure 1:
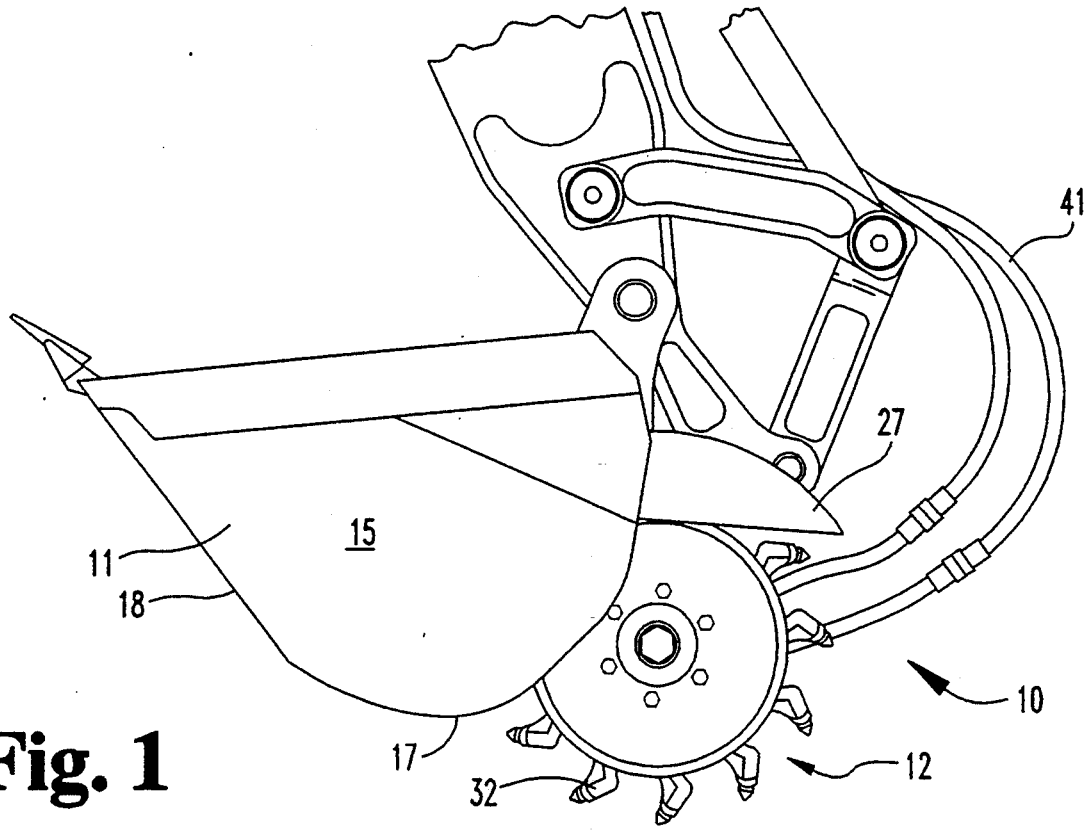
FIG. 1 is a right side elevational view of the pavement cutting and excavating tool of the present invention, according to one preferred embodiment.
Figure 3:
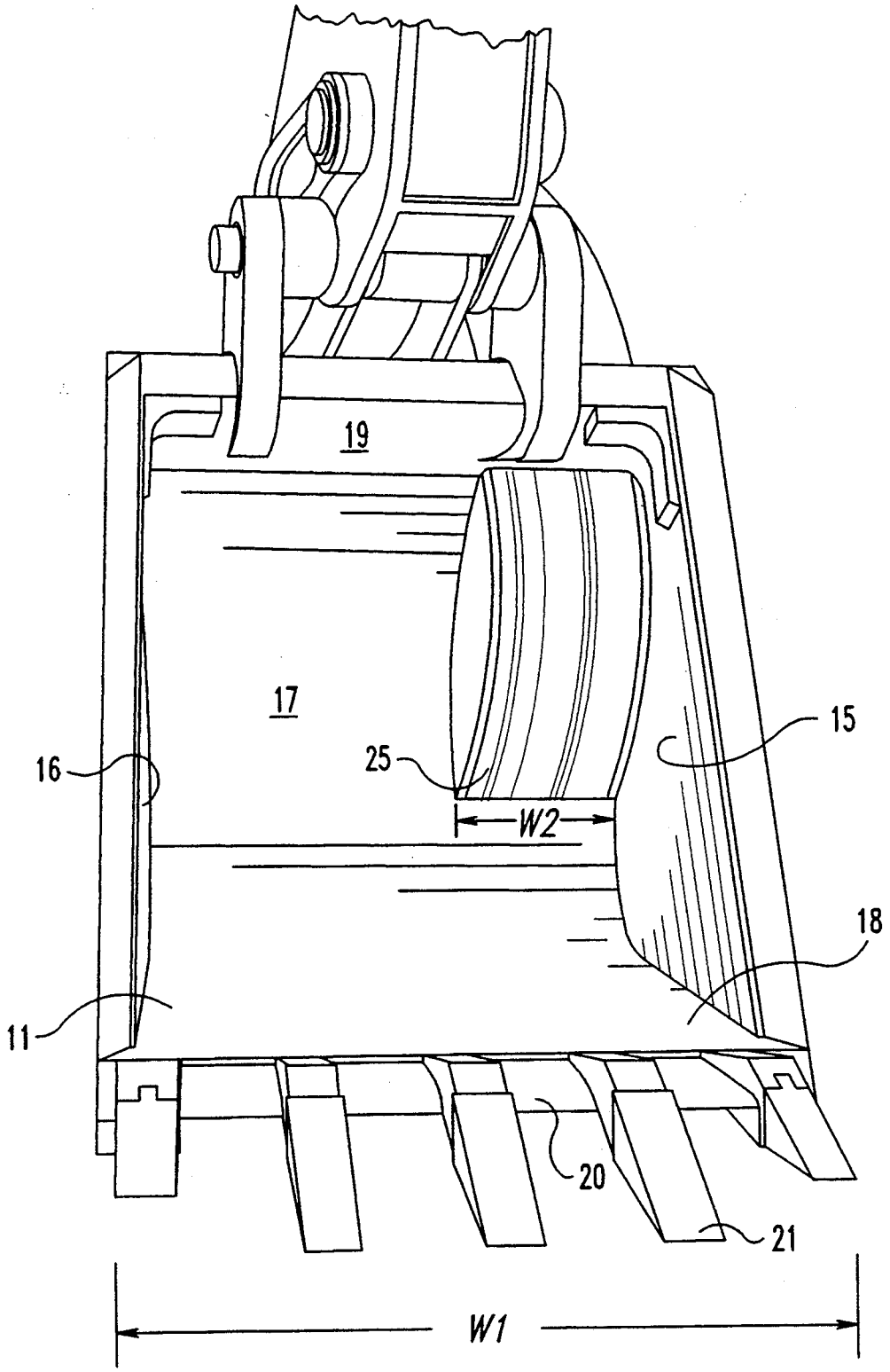
FIG. 3 is a top view of the pavement cutting and excavating tool of FIG. 1.
Figure 4:
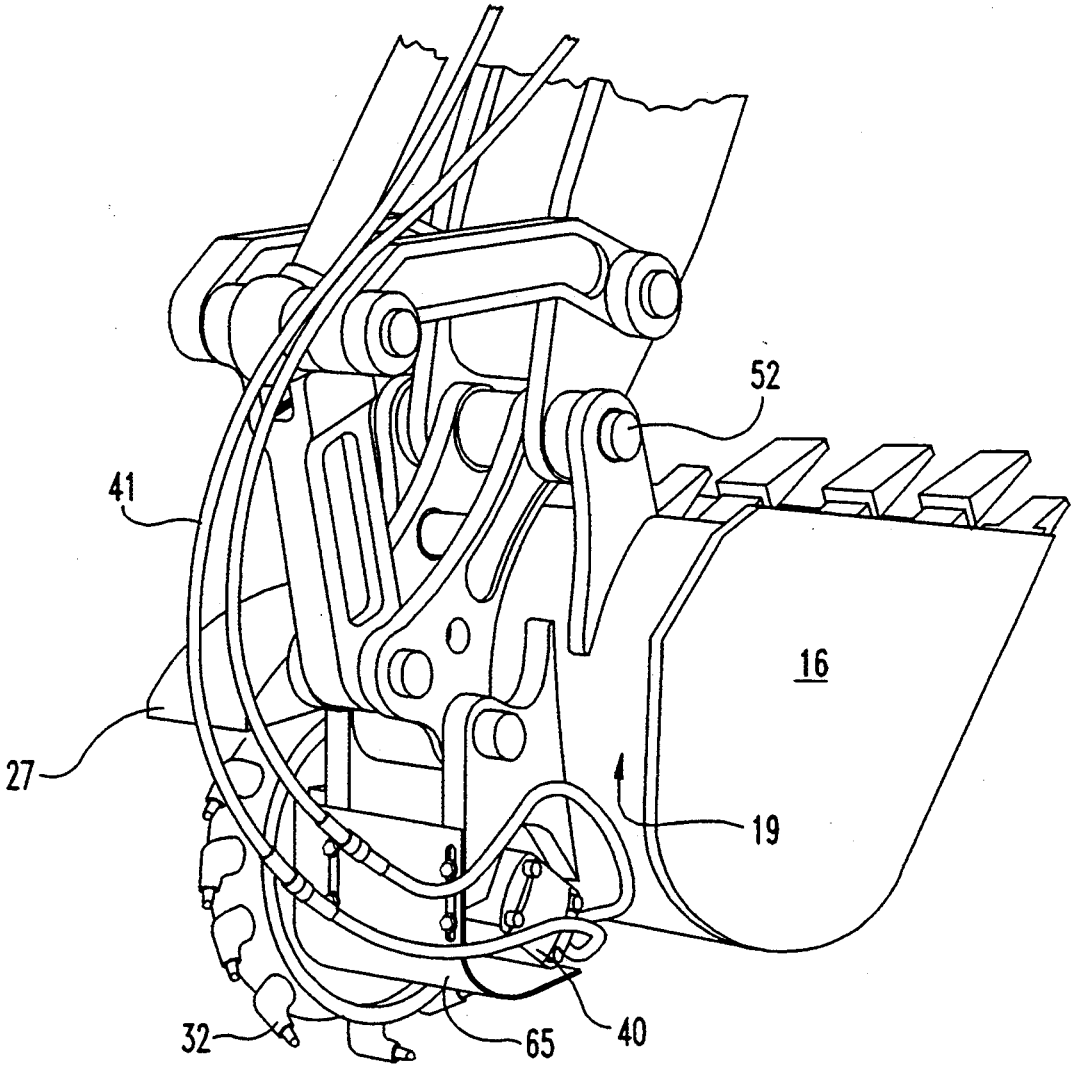
FIG. 4 is a rear view of the pavement cutting and excavating tool of FIG. 1.
Figure 5:
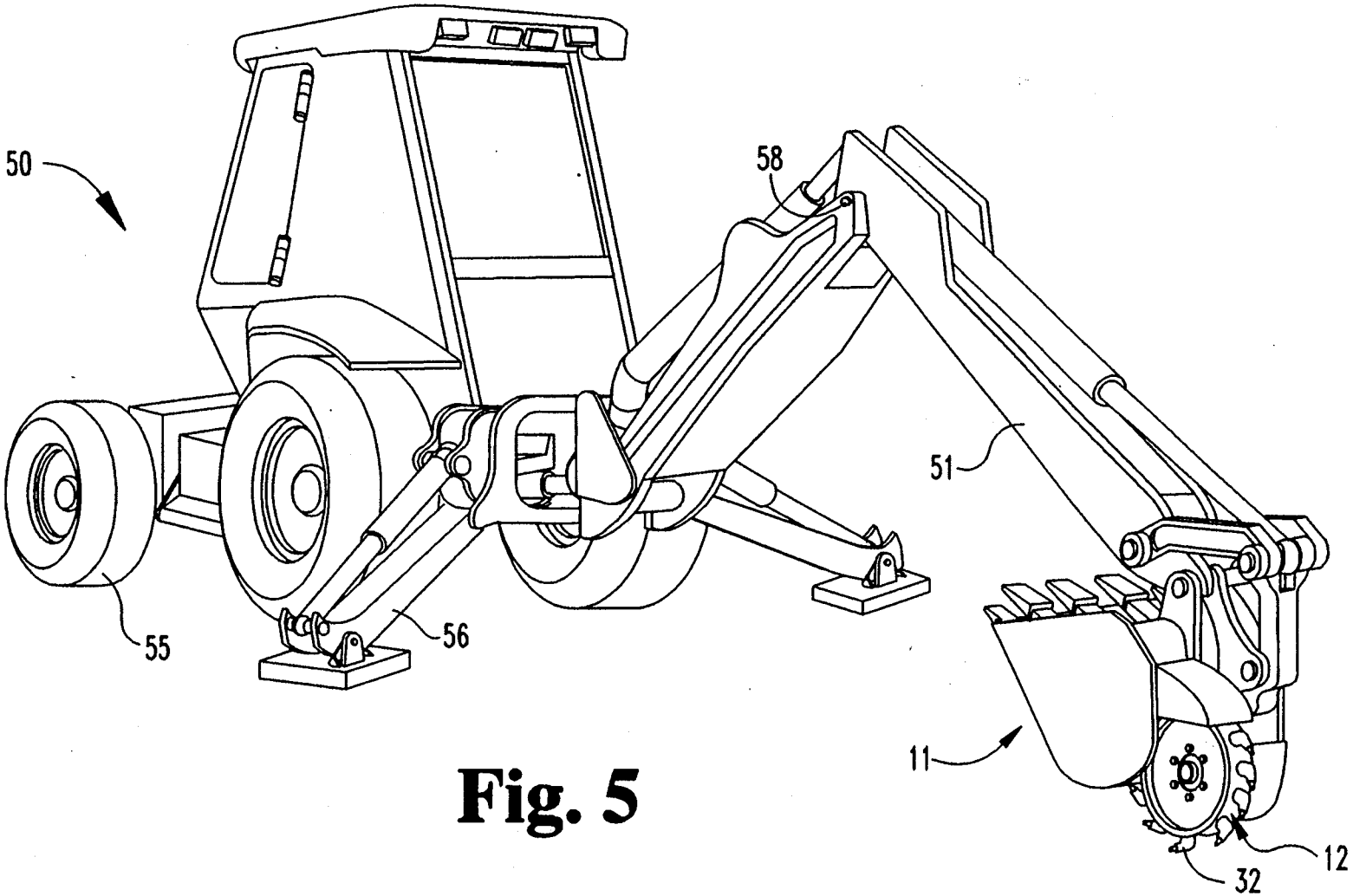
FIG. 5 shows the pavement cutting and excavating tool of the present invention mounted to a construction vehicle.
Figure 6:
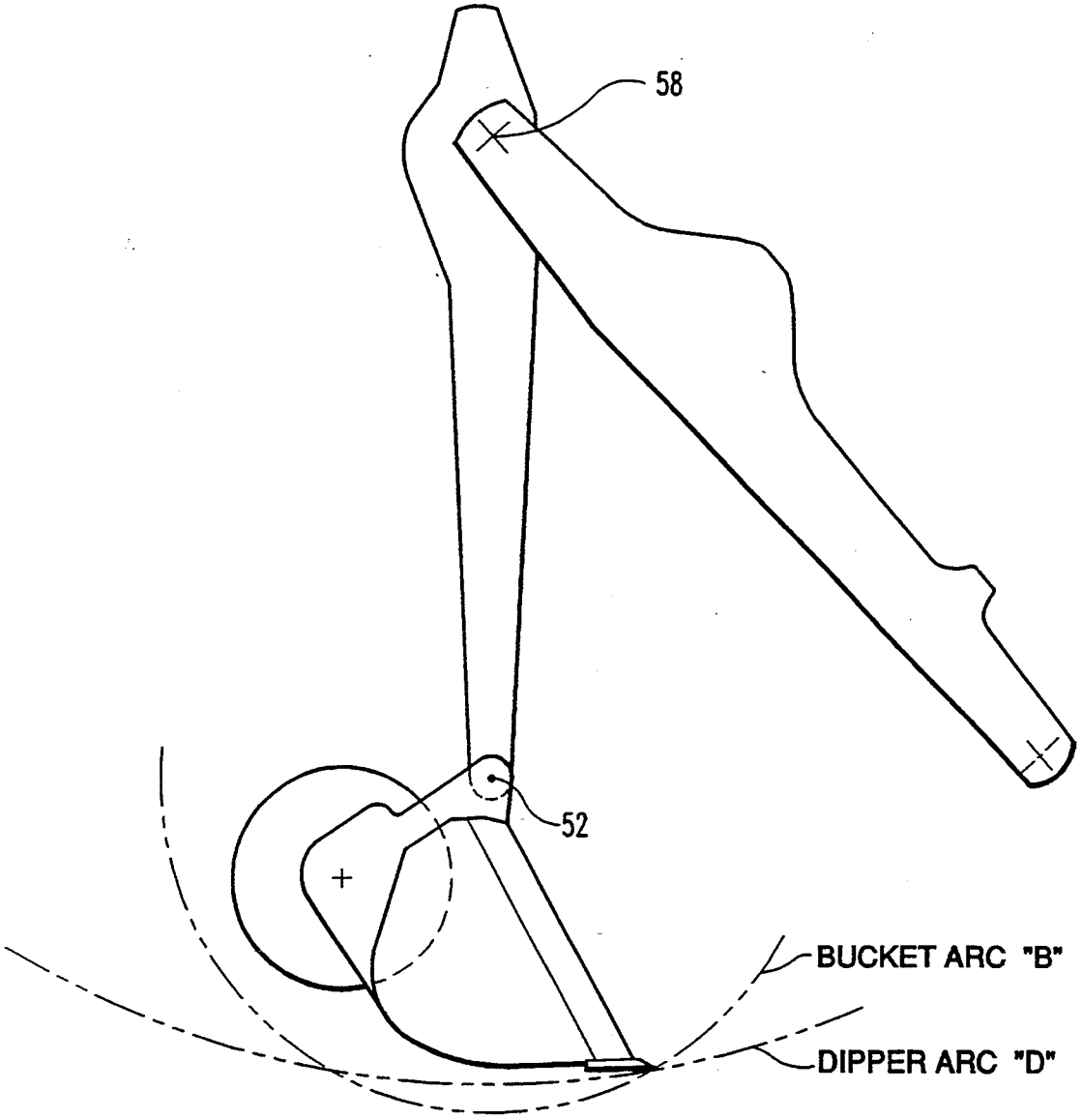
FIG. 6 is a diagram of the bucket arc "B" and dipper arc "D" defined by the rotation of the pavement cutting and excavating tool of the present invention about pins holding the bucket and the backhoe arm respectively.

For the purpose of promoting an understanding of the principles of the invention, reference will now be made to preferred embodiments and specific language will be used to describe the same. It will nevertheless be understood that no limitation of the scope of the invention is thereby intended, such alterations and further modifications in the illustrated embodiments, and such further applications of the principles of the invention as illustrated herein being contemplated as would normally occur to one skilled in the art to which the invention pertains.

Referring generally to the drawings, pavement cutting and excavating tool 10 comprises an excavation bucket 11 and a cutting disc 12. The tool is mountable to a construction vehicle 50 such as a backhoe. A disc housing 25 is disposed in the backhoe bucket, and the cutting disc 12 is in the housing. Accordingly, cutting disc 12 substantially narrower than excavation bucket 11, e.g. less than one-third the bucket width.

More particularly, bucket 11 includes first side 15, second side 16 and bottom 17. A front portion 18 and a rest portion 19 may be formed by extending bottom 17, or they may be separately provided. Bucket 11 also includes an excavating edge 20 which may include teeth 21 for assisting digging. As will be more fully described, the bucket also includes a portion concave therein for reception of a cutting disc.

The concave portion of the bucket defines a cutting disc housing 25 disposed in bucket 11 between first side 15 and second side 16. In one preferred embodiment, cutting disc housing 25 is shaped as a quarter-cylinder, with the curved surface of the housing extending well into the excavating bucket. In another preferred embodiment disc housing 25 includes an exterior shield portion 27 extending outward from the rear portion 19 of excavating bucket 11. Also preferably, the housing is less than one-half of the width of the bucket, most preferably about one-third of that width. Accordingly, a narrow-width cutting tool may effectively be accommodated by the housing.

A cutting disc 12 is partially disposed in housing 25, with enough of the cutting disc being exposed to facilitate cutting concrete or asphalt pavement. As indicated, a shield may be provided to substantially cover the upper part of the exposed portion of the cutting disc, thereby preventing pieces of concrete, rock or dirt from being flung toward the operator or others at the worksite. It is to be appreciated that the cutting disc is recessed in the bucket of the present invention when the disc is disposed in its housing. Because the housing is more narrow than the bucket, the recessed cutting disc does not eliminate the entire lower portion of the bucket.

The cutting disc 12 is effective for cutting concrete or asphalt pavement, and preferably includes teeth 32 extending from the disc's outer surface. The teeth are designed and positioned to facilitate cutting concrete. The cutting disc is substantially more narrow than the excavating bucket; preferably a disc about 2½ inches wide is used in a 24 inches wide bucket. Appropriate cutting discs for use in the present invention may be selected by persons skilled in the art without undue experimentation.

A motor 40 turns cutting disc 12 at a speed and with a power effective to cut concrete or asphalt. The motor is controlled by control means 41 operationally linked to construction vehicle 50, and most preferably operates at a variety of speeds. Appropriate motors for use in the present invention may be selected by persons skilled in the art without undue experimentation.

The entire pavement cutting and excavating tool 10 is mountable to extendable dipper arm 51 extending from vehicle 50. Conventional mounting means such as pins 52–54 are provided for that purpose. Vehicle 50 also includes wheels 55 or tracks to facilitate movement around the construction site. Stabilizers 56 may also be included. Here too, appropriate vehicles and mounting means may be selected by persons skilled in the art without undue experimentation.

In use, the pavement cutting and excavating tool is provided on a construction vehicle with an extendable boom arm 51. The tool is lowered to the pavement until only cutting disc 12 and depth control shoe 65 contact the pavement surface. The cutting disc is used to make a narrow cut in the concrete, and the tool is subsequently repositioned so that bucket 11 may be used to remove concrete or dirt. The excavation bucket removes cut concrete, rock and dirt in the conventional manner.

Depth control means for allowing the tool to cut only to a predetermined depth may also be provided. In one preferred embodiment the depth control means comprises a fixed diameter guide 65 mounted to the tool and replaceable with other fixed diameter guides to selectively restrict the downward travel of the cutting disc to a predetermined depth. Guide 65 preferably includes an arcuate shape centered at the axis of rotation of cutting disc 12. In this manner, the cutting disc is held at a predetermined depth as it is drawn over the surface.

It is to be appreciated that the most radially extending portion of bucket 11 defines a bucket arc B when bucket 11 is pivoted about its scooping axis, such as the axis defined by pin 52. Similarly, the most radially extending portion of bucket 11 defines a dipper arc D when arm 51 is pivoted about its dipping axis, such as the axis defined where arm 51 pivotably joins the main boom, most particularly the axis defined by pin 58. The cutting disc is positioned so as not to interfere with the operation of the excavating bucket when either a scooping or a dipping operation is performed. In particular, cutting disc 12 is positioned to be wholly above (within) bucket arc B and/or dipper arc D when the cutting and excavating tool is pivoted about either pin 52 or pin 58.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A pavement cutting and excavating tool, comprising:

(a) an excavation bucket mountable to a construction vehicle such as a backhoe, said bucket including:
  (i) a first side portion; and
  (ii) a second side portion;

wherein said first side portion and said second side portion are positioned in a spaced-apart relation and define a bucket width;

(b) a concave disc housing disposed between said first side portion and said second side portion, said disc housing extending into said bucket; and (c) a cutting disc for cutting through concrete or asphalt, said cutting disc being disposed in said disc housing;

wherein said cutting disc defines a cutting disc width which is less than said bucket width and wherein said disc housing defines a housing width which is less than said bucket width.

2. The pavement cutting and excavating tool of claim 1 wherein said disc housing extends out of said bucket.

3. The pavement cutting and excavating tool of claim 1 wherein said cutting disc width is less than one-third of said bucket width.

4. The pavement cutting and excavating tool of claim 1, and further including a motor for turning said cutting disc at a speed effective to cut concrete and asphalt.

5. The pavement cutting and excavating tool of claim 1 wherein said cutting disc includes cutting teeth extending radially therefrom.

6. The pavement cutting and excavating tool of claim 1, and further including control means for controlling said excavation bucket and said cutting disc.

7. The pavement cutting and excavating tool of claim 1, and further including guide means for selectively controlling the depth of a cut, said guide means having a guide surface radially spaced concentric to the cutting wheel.

8. The pavement cutting and excavating tool of claim 1 wherein said cutting disc is recessed into said basket.

9. A construction vehicle, comprising:

(a) a backhoe, including an extendable dipper arm;

(b) an excavation bucket mounted to said backhoe, said bucket including:
  (i) a first side portion; and
  (ii) a second side portion;

wherein said first side portion and said second side portion are positioned in a spaced-apart relation and define a bucket width;

(c) a concave disc housing disposed between said first side portion and said second side portion, said disc housing extending into said bucket; and (d) a cutting disc for cutting through concrete or asphalt, said cutting disc being disposed in said disc housing;

wherein said cutting disc defines a cutting disc width which is less than said bucket width and wherein said disc housing defines a housing width which is less than said bucket width.

10. The pavement cutting and excavating tool of claim 9 wherein said cutting disc does not extend below a bucket arc defined by a scooping motion of said bucket.

11. The pavement cutting and excavating tool of claim 9 wherein said cutting disc does not extend below a dipper arc defined by a dipping motion of the extendable dipper arm.

12. The pavement cutting and excavating tool of claim 9 wherein said bucket includes a portion concave therein for reception of said cutting disc.

* * * * *